US010364061B2

(12) United States Patent
Eckert et al.

(10) Patent No.: US 10,364,061 B2
(45) Date of Patent: Jul. 30, 2019

(54) RECLOSABLE CONTAINER

(71) Applicant: NESTEC S.A., Vevey (CH)

(72) Inventors: Sebastian Eckert, Frankfurt (DE); Rafael Schraml, Konolfingen (CH); Marco Vierling, Mainz (DE); Martin Zelosko, Wiesbaden (DE)

(73) Assignee: Nestec S.A., Vevey (CH)

( * ) Notice: Subject to any disclaimer, the term of this patent is extended or adjusted under 35 U.S.C. 154(b) by 91 days.

(21) Appl. No.: 15/519,000

(22) PCT Filed: Oct. 13, 2015

(86) PCT No.: PCT/EP2015/073711
§ 371 (c)(1),
(2) Date: Apr. 13, 2017

(87) PCT Pub. No.: WO2016/059070
PCT Pub. Date: Apr. 21, 2016

(65) Prior Publication Data

US 2017/0240314 A1 Aug. 24, 2017

(30) Foreign Application Priority Data

Oct. 16, 2014 (EP) ..... 14189122

(51) Int. Cl.
*B65D 5/54* (2006.01)
*B65D 5/66* (2006.01)
(Continued)

(52) U.S. Cl.
CPC ..... *B65D 5/543* (2013.01); *B65D 5/4266* (2013.01); *B65D 77/02* (2013.01); *B65D 85/70* (2013.01); *B65D 5/5425* (2013.01)

(58) Field of Classification Search
CPC .... B65D 5/543; B65D 5/5425; B65D 5/4266; B65D 77/02; B65D 5/70
(Continued)

(56) References Cited

U.S. PATENT DOCUMENTS 2,369,387 A * 2/1945 Williamson ..... B65D 5/6608 206/268
2,403,698 A * 7/1946 Williamson ..... B65D 5/6608 229/145
(Continued)

FOREIGN PATENT DOCUMENTS

CN 1206384 A 1/1999
CN 103118960 A 5/2013
(Continued)

*Primary Examiner* — Justin M Larson
(74) *Attorney, Agent, or Firm* — K&L Gates LLP

(57) ABSTRACT

The present invention relates to a reclosable container comprising a bottom panel, a front panel, two side panels, a rear panel and a top panel. The front panel and the two side panels having a division line extending downwardly sloping from the rear panel in the side panels and horizontally in at least a part of the front panel thereby defining a lid. The lid comprises the top panel and the sections of the front panel and side panels above the division line, and the lid is moveable by rotation along a folding line in the rear panel between a closing position, where the lid closes the container, and a position where an open end of the container is not covered by the lid. The container further comprises an inner side part and an inner front part extending above the division line. Each inner side part has an upper margin sloping downwardly towards the rear panel The inner front part comprises a flap extending downwardly from an upper margin of the inner front part.

15 Claims, 5 Drawing Sheets

(51) Int. Cl.
*B65D 77/02* (2006.01)
*B65D 5/42* (2006.01)
*B65D 85/00* (2006.01)

(58) Field of Classification Search
USPC ..... 229/160.1, 160.2
See application file for complete search history.

(56) References Cited

U.S. PATENT DOCUMENTS 2,889,100 A * 6/1959 Baker ..... B65D 5/543 126/299 R
3,283,991 A * 11/1966 Hughes ..... B65D 5/5415 229/145
3,432,090 A * 3/1969 Engel ..... B65D 5/64 229/145
3,486,682 A * 12/1969 Whipperman ..... B65D 5/0005 229/101
3,910,487 A * 10/1975 Jaeschke ..... B65D 5/5435 206/425
4,048,052 A * 9/1977 Tolaas ..... B65D 5/548 229/145
5,161,734 A * 11/1992 Ruehl ..... B65D 5/5415 229/147
5,265,799 A * 11/1993 Stone ..... B65D 5/543 229/122.33
5,314,114 A * 5/1994 Stone ..... B65D 5/4291 229/122.32
5,515,996 A * 5/1996 Stone ..... B65D 5/5425 229/122.32
5,725,144 A * 3/1998 Stone ..... B65D 5/3607 229/101
5,896,984 A * 4/1999 Focke ..... B65D 85/1045 206/268
D461,122 S * 8/2002 Bryan ..... D9/423
6,913,190 B2 * 7/2005 Ruhbusch ..... B65D 5/5435 229/145
7,938,312 B2 * 5/2011 Ford ..... B65D 5/542 229/117.3
8,875,878 B2 * 11/2014 Young ..... B65D 5/6691 206/268
9,346,582 B2 * 5/2016 Pinkstone ..... B65D 5/5415
10,173,831 B2 * 1/2019 Mitten ..... B65D 5/662
2003/0116614 A1 * 6/2003 Block ..... B65D 5/4291 229/146
2005/0109827 A1 * 5/2005 Martin ..... B65D 5/5435 229/232
2008/0230410 A1 * 9/2008 Steven Jones ..... B65D 5/4291 206/268
2009/0001145 A1 * 1/2009 Hasse ..... B65D 5/543 229/117.12
2017/0240314 A1 * 8/2017 Eckert ..... B65D 77/02
2017/0334600 A1 * 11/2017 Eckert ..... B65D 77/02
2017/0355484 A1 * 12/2017 Eckert ..... B65D 77/02

FOREIGN PATENT DOCUMENTS

DE 102012019557 4/2014
EP 2072410 6/2009
GB 596645 1/1948

* cited by examiner

RECLOSABLE CONTAINER

CROSS REFERENCE TO RELATED APPLICATIONS

The present application is a National Stage of International Application No. PCT/EP2015/073711, filed on Oct. 13, 2015, which claims priority to European Patent Application No. 14189122.6, filed on Oct. 16, 2014, the entire contents of which are being incorporated herein by reference.

FIELD OF THE INVENTION

The present invention relates to a reclosable container comprising a bottom panel, a front panel, two side panels, a rear panel and a top panel. The front panel and the two side panels having a division line extending downwardly sloping from the rear panel in the side panels and horizontally in at least a part of the front panel thereby defining a lid. The lid comprises the top panel and the sections of the front panel and side panels above the division line, and the lid is moveable by rotation along a folding line in the rear panel between a closing position, where the lid closes the container, and a position where an open end of the container is not covered by the lid. The container further comprises an inner side part and an inner front part extending above the division line. Each inner side part has an upper margin sloping downwardly towards the rear panel The inner front part comprises a flap extending downwardly from an upper margin of the inner front part.

BACKGROUND OF THE INVENTION

Containers with a hinged lid are often referred to as flip top boxes. Such flip top boxes are used for numerous storing purposes. One example of a flip top box is disclosed in U.S. Pat. No. 2,889,100. The disclosed flip top box is a paper board carton formed from a single composite blank comprising two coextensive substantially identical oblong blanks secured together face to face and providing inner and outer plies respectively of said carton, the latter comprising an open top body and a lid, the lid being hinged to a back panel.

While such containers find great use, they often suffer from the drawback of being difficult to re-close. The difficulties experienced are inter alia that when the lid is rotated towards its closing position, the closing operation may become obstructed by the elements of the container which are intended to be situated inside the lid after closing, thus blocking the passage of the lid towards its closing position.

Hence, an improved container would be advantageous, and in particular a more efficient and/or reliable reclosing of the container would be advantageous.

OBJECT OF THE INVENTION

It is an object of the present invention to wholly or partly overcome the above disadvantages and drawbacks of the prior art. More specifically, it is an object to provide a container which provides efficient and/or reliable reclosing.

SUMMARY OF THE INVENTION

Thus, the above described object and several other objects are intended to be obtained in a first aspect of the invention by providing a reclosable container comprising a bottom panel, a front panel, two side panels, a rear panel and a top panel.

The front panel and the two side panels are having a division line extending downwardly sloping from the rear panel in the side panels and horizontally in at least a part of the front panel. A lid is thereby defined, the lid comprising the top panel and the sections of the front panel and side panels above the division line. The lid is moveable by rotation along a folding line in the rear panel between a closing position, where the lid closes the container and a position where an open end of the container is not covered by the lid.

Preferably, the folding line along which the lid is moveable by rotation extends inbetween the onset of the division lines extending downwardly sloping from rear panel. As the onset of division line may be located at distance away from the upper most part of the side panels, the lid will in such embodiments further comprise the section of the rear panel located above the folding line.

Further, the front panel comprises an inner front part extending above the division line in the front panel without being attached to the front panel above the division line. Each side panel comprises an inner side part extending above the division line in the side panel without being attached to the side panel above the division line, the upper margin of each of the inner side parts extending downwardly sloping towards the rear panel. The inner front part comprises a flap extending downwardly from an upper margin of the inner front part and abuts an inner surface of the section of the front panel above the division line when the lid is in the position where it closes the container.

By the provision of the division line on the side panels sloping downwardly from the rear panel (thereby providing a lid with corresponding sloping), of inner side parts having upper margins downwardly sloping towards the rear panel and of the flap extending downwardly from an upper margin of the inner front part, an easier closing is achieved. The sloping margins in combination with the flap provide a guiding of the lid during its rotation towards closing of the container, which may guide the panels sections of the lid outwardly—and/or guide the inner front part and inner side parts inwardly—so as to at least mitigate the risk of the lid to engage un-intentionally with the inner front and/or the inner side part.

A number of terms are used herein in a manner being ordinary to a skilled person. Some of these words are explained in further details below.

In the present invention, orientations are used such as side, front, rear, up, down. Such orientations are preferably used as presented in the figures; however, the orientation of the container—and therefore also the various orientations referenced—is chosen so that the lid is on top of the container, rear typically defines as the position where the lid is connected when the lid is opened. Front is opposite to rear, and side is in-between front and rear.

Panel is preferably used to mean a section of a container e.g. bordered by folding lines at least along a part of the panels perimeter. Panel is also used in a broad sense to mean a sheet of material. In case of cubic shaped container, this means that each part comprising a surface of the cube is typically considered to be a panel.

Preferably, the inner front part may be provided by a panel provided on the inside of the front panel below the division line in the front panel, and the inner side parts may be provided by panels provided on the inside of the side panels below the division line. It is noted that the inner front part and the inner side parts are not necessarily attached to the inside of the side panels and front panel.

Preferably, the lid may comprise a ledge provided on the inner surface of the section of the front panel above the division line in a position where the lower margin of the downwardly extending flap engages with an upper edge of the ledge, when the lid is in the position where it closes the container.

Preferably, a distance may be provided between the upper margin of the inner front part and the inner surface of the top, when the lid is in the position where it closes the container.

Preferably, the corners of the flap and/or corners of the inner front part may be rounded and/or truncated. Typical and preferred size for the truncation is between 70 and 30, preferably between 60 and 40 degrees, most preferably 45 degrees.

Preferably, a vertical distance is provided between the upper most part of the inner side part and the upper margin of the inner front part from which the flap extends downwardly. Thereby, the upper margin of the inner front part is provided at a higher position than the upper most part of the inner side parts. The division line may preferably be a scoring line comprising a plurality of piercings in the side panels and the front panel. Preferably, the piercings may be oblong cut-outs.

The division line in the front panel may preferably curve downwardly in between two substantial straight parts, and the section of the front panel above the division line may comprise a downwardly protruding tongue resembling the curvature of the division line.

Preferably, the folding line in the rear panel along which the lid is rotated may be pre-provided, such as by embossing.

The container may preferably be made from paper, cardboard, metal and/or plastic, or of a laminate thereof. Most preferably, it is made of paper and/or cardboard.

The container may preferably have horizontal and vertical rectangular cross sections.

Preferably, the container may be made from one or more sheet of material being folded and glued and/or welded to form the container.

The container may advantageously store one or more pouches inside the container. Preferably, the pouch may have a horizontal extension being smaller than the distance from the bottom panel of the container and to the lower most position of the upper margin of each of the inner side parts.

Preferably, a container according to the present invention may further comprise a tear-off flap, the tear-off flap being connected with the flap along a scoring line and being glued or welded, during production of the container, to the inside of the part of the lid provided by the section above the division line of the front panel.

A second aspect of the invention relates to the use of a container as described above for storing of a food product. Such a use may e.g. be for storing of milk powder.

Further embodiments, details and aspects are presented below as well as in the claims.

BRIEF DESCRIPTION OF THE FIGURES

The present invention will now be described in more details with regard to the accompanying figures. The figures show one way of implementing the present invention and are not to be construed as being limiting to other possible embodiments falling within the scope of the attached claim set.

DETAILED DESCRIPTION OF PREFERRED EMBODIMENTS

Figure 1:
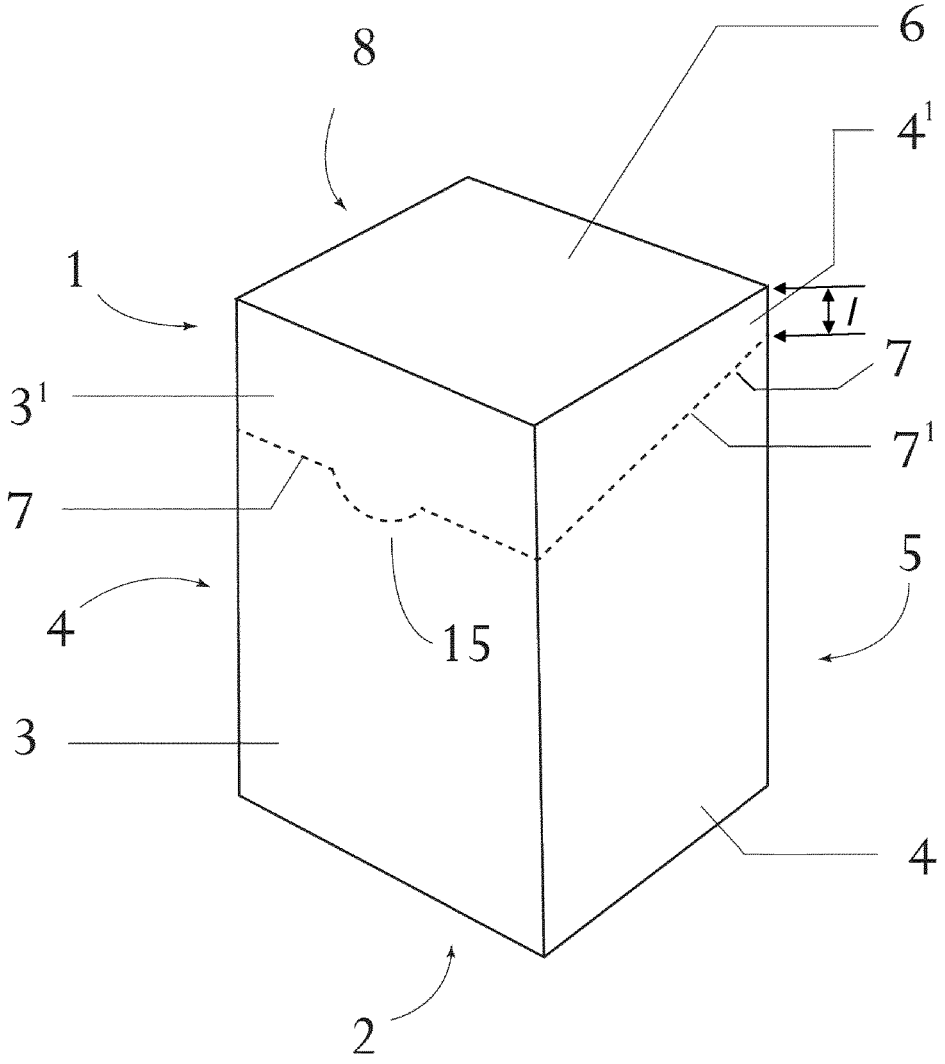
FIG. 1 is a perspective and schematic illustration of a container according to a preferred embodiment of the invention in a closed configuration.

Reference is made to FIG. 1 which illustrates schematically and in a perspective view a reclosable container 1 according to a preferred embodiment. As illustrated, the container 1 comprises a bottom panel 2, a front panel 3, two side panels 4, a rear panel 5 and a top panel 6. The panels of the container are preferably flat sheets of material.

A container 1 according to the present invention comprises a lid 8. This lid is provided by the front panel 3 and the two side panels 4 each of which has a division line 7. As presented in the figure, the division line 7 (dotted line) extends from the edge between the side panel 4 and the rear panel 5 along the side panel 4, continues across the front panel 3 and to the edge between the opposite side panel 4 and the rear panel 5. As also visible in FIG. 1, the division line 7 extends downwardly sloping from the rear panel 5 in the side panels 4 and horizontally in at least a part of the front panel 3. The division line 7 extends in the panels in order to either separate or provide a separation of the panels into sections.

The division line 7 thereby defines a lid 8 above the division line 7. The lid 8 comprises the top panel 6 and the section 3' of the front panel (3) and the two sections 4' of the side panels 4 above the division line 7. As no division line 7 is provided in the rear panel 5, the lid is not separated from the container and the lid 8 is moveable by rotation along a folding line in the rear panel 5. It is noted that the division line 7 may also extend into the rear panel, but not in a manner or an extent so that the lid is separated from the rear. Further, the part of the rear panel 5 above the folding line is considered a part of the lid 8.

The folding line in the rear panel 5 may be provided prior to a first opening of the lid 8, e.g. by embossing during production of the container, or it may be provided by the action of the first opening of the lid 8. As the lid 8 may be folded backward more the 90 degrees, the lid 8 may stay open without any need for retaining it.

Figure 2:
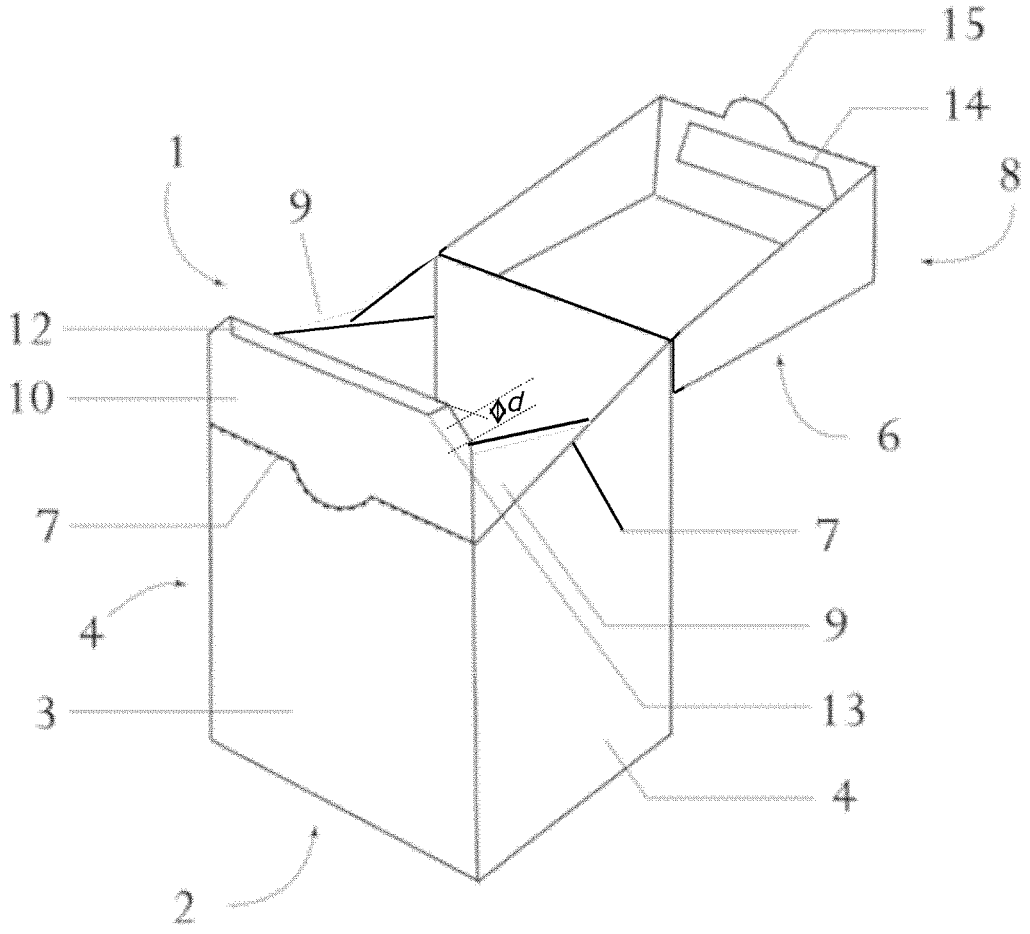
FIG. 2 is a perspective and schematic illustration of the container of FIG. 1 in an open configuration.

Thus, the thereby defined lid 8 is moveable between a closed position, where the lid 8 closes the container 1, and a position where an open end of the container is not covered by the lid 8. This position is shown in FIG. 2.

The folding line along which the lid is moveable by rotation extends inbetween the onset of the division lines 7 extending downwardly sloping from rear panel 4. As the onset of division line may be located at distance ("/" in FIG.

1) away from upper most part of the side panels, the lid will in such embodiments also comprise the section of the rear panel 5 located above the folding line. In preferred embodiments, the dimension of / is preferably between 25 and 5%, preferably between 20 and 10%, most preferably 15% of the height of the rear panel 5. In other embodiments, / is selected to be 0% of the height of the rear panel 5.

In order to provide an easy reclosing of the container 1, the front panel 3 further comprises (see FIG. 2) an inner front part 10 extending above the division line 7 in the front panel 3 without being attached to the front panel 3 above the division line 7. Further, each side panel 4 comprises an inner side part 9 extending above the division line 7 in the side panel 4 without being attached to the side panel 4 above the division line 7. Advantageously, the upper margin of each of the inner side parts 9 extends downwardly sloping towards the rear panel 5, as shown in FIG. 2. This downward sloping towards the rear panel 5 may be seen as providing a guide which reduce the sections 4' from engaging un-intentionally with inner side part 9 as disclosed above.

While the inner side parts 9 reduce the risk of un-intentional engagement of the sections 4', the section 3' may still be prone to un-intentional engagement with the inner front part 10. In order to further reduce this risk, the inner front part 10 comprises a flap 12 (see FIG. 2) extending downwardly from an upper margin of the inner front part 10. This flap 12 is arranged so that it abuts an inner surface of the section 3' of the front panel 3 above the division line 7 when the lid 8 is in the position where it closes the container 1. In the situation, where the lid 8 is in the position where the container is open, the flap 12 extends downwardly and outwardly, where the outwardly extending typically is provided by the material being resilient and the flap is provided by folding along a folding line which after folding is the upper margin of the inner front part 10.

As seen in FIG. 2, there is provided a vertical distance d between the upper most part of the inner side part 9 and the upper margin of the inner front part 10 from which the flap 12 extends downwardly. In FIG. 2, sight lines for indicating the vertical distance d are shown with dotted lines. The dimension of d is preferably selected to be less than 15%, such as less than 10%, and even less than 5% and preferably more than 1%, preferably more than 2% of the height of the front panel 3. Thus, the upper margin of the inner front part 10 is higher than the upper most part of the inner side parts 9. This assists in an easy reclosing of the container, as the lid when moved towards it closing position will initially be guided by flap 12 to deflect the section 3' outwardly and/or the inner front part 10 inwardly.

When the lid 8 is moved from the position shown in FIG. 2 to the position shown in FIG. 1, after section 3' meets the inner front part 10, thus guiding the section 3' outwardly and/or the inner front section 10 inwardly, the upper margins of the inner side parts 9 will in turn guide the sections 4' outwardly and/or the sections 4' will guide the inner side parts 9 inwardly Thereby an easy reclosing of the container 1 is provided.

In a preferred embodiment, the inner front part 10 is provided by a panel provided on the inside of the front panel 3 below the division line 7 in the front panel 3, and the inner side parts 9 are provided by panels provided on the inside of the side panels 4 below the division line 7. Such panels may be separate panels which are attached to the inside of the panels of the container 1, e.g. by gluing and/or welding. However, in some preferred embodiments, the panels used as inner side parts 9 and inner front part 10 is made from a single sheet being folded into an insert so as to fit inside the container. It is further noted that in the latter case, the folded single sheet may not need to be attached to the inside of the container as it may be given a longitudinal extension so that it may rest at the bottom panel 2 of the container. However, also in this case, it may be advantageous to attached the inset to the inside of the container 1.

It is often preferred that the container is prevented from being opened unintentionally and a locking mechanism is often preferred, which locking mechanism should preferably provide a tactile and/or a hearable response to inform the user that the container is closed and locked. To this, the the lid 8 may be provided with a ledge 14 provided on the inner surface of the section 3' of the front panel 3 above the division line 7 in a position where the lower margin of the downwardly extending flap 12 engages with an upper edge of the ledge 14, when the lid 8 is in the position where it closes the container 1.

Thereby, the flap 12 will, when the lid 8 is to be positioned in the closed position, bend inwardly and/or the section 3' will bend outwardly until the flap 12 is able to bend outwardly. This may provide a snapping of the flap 12 which, depending on the strength of the material used for the container, provide a hearable and/or a tactile snap. The position at which the container is locked is shown in FIG. 3, which illustrates the interior of the container at an upper corner with a part of the section 4' cut away for illustration only.

Figure 3:
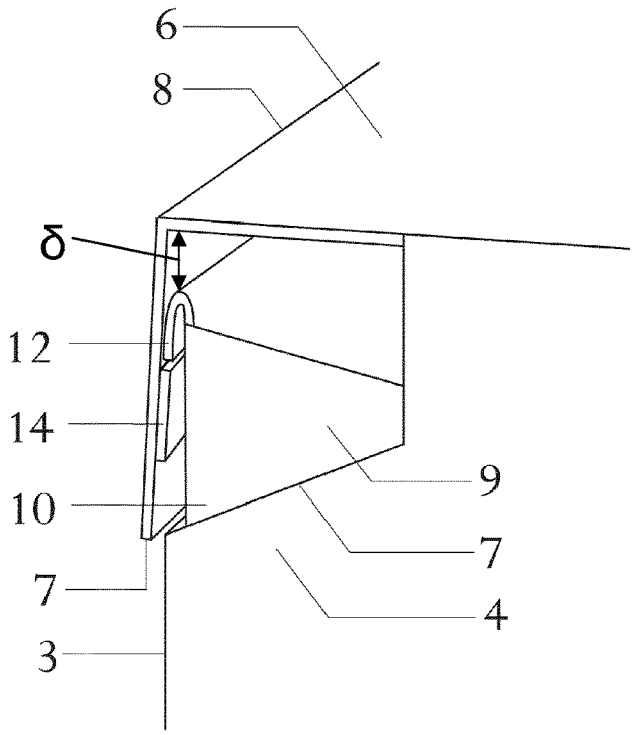
FIG. 3 is a close-up perspective and schematic illustration of a section of the container of FIG. 1; the section is shown with some material removed to reveal a part of the interior container.

In order to e.g. provide sufficient space for maneuvering the flap 12 into the position where it engages with the ledge 14, the ledge 14 and the flap 12 are mutually arranged so as to provide a distance between the upper margin of the inner front part 10 and the inner surface of the top 6, when the lid 8 is in the position where it closes the container 1—this is illustrated in FIG. 3 by the distance δ.

Figure 5:
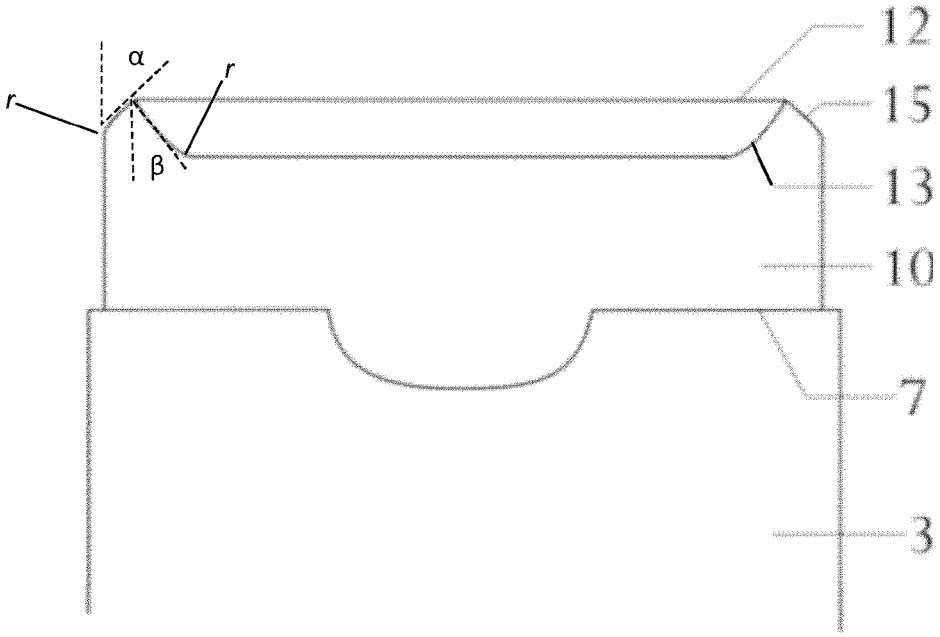
FIG. 5 is a schematic illustration of a region of a container, the container is illustrated from in front and only the inner front part and a part of the front panel is disclosed.

In order to further facilitate easy reclosing of the container, sharp and/or pointing corners could advantageously be removed, and in the preferred embodiment shown in the figures (see in particular FIG. 5, reference 13 and 15), the corners 13 of the flap 12 and/or corners 15 of the inner front part 10 are preferably rounded and/or truncated. Typical size for the truncation (α, β in FIG. 5) is 45 degrees as shown in FIG. 5, where the corners 15 of the inner front part 10 and the corners 13 of the flap 12 are truncated by an angle of α and β respectively. In addition, in the embodiment shown in FIG. 5 the corners are furthermore rounded, which is indicated by "r" in FIG. 5. Such roundings may be omitted.

Figure 4:
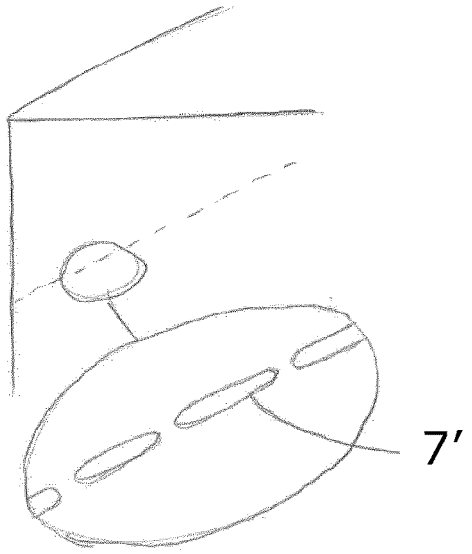
FIG. 4 is a close-up perspective and schematic illustration of a section of the container of FIG. 1; a division line is illustrated in a further close-up view within FIG. 4.

In accordance with preferred embodiments, the division line 7 is a scoring line. Such a scoring is in general constituted by a local weakening of the material along the line, which weakening will provide a kind of tear open of the container along the line when a force is applied to the parts comprising the division line during the initial opening operation; the weakening is typically of such a kind that the container may be opened by hand without requiring any kind of tools. As illustrated in FIG. 4, the division line typically comprises a plurality of piercings 7' in the side panels 4 and the front panel 3. In the case the inner side parts 9 and the inner front part 10 is attached to the inner side of the side panels 4 and front panel 3 respectively, the piercing—or in general the division line 7—does not extend into the inner side parts 9 or the inner front part 10. As illustrated in the close-up illustration of FIG. 4, the the piercings 7' are preferably oblong cut-outs.

A downwardly protruding tongue 15 may be provided in the lid 8. This tongue is in the embodiment shown in the figures provided by the division line 7, which curves downwardly in between two substantial straight parts in the front panel 3, and thus the section 3' of the front panel 3 above the division line 7 comprises a downwardly protruding tongue 15 resembling the curvature of the division line 7. This tongue 15 provides an intuitive starting point to push inwardly in order to provide an initial brake of the division line 7 when the container is opened for the first time. At later openings, the tongue 15 may also serve as a flap that can be gripped during opening. Further, the tongue 15 may also co-operate with the flap 12 to further enhance an easy reclosing of the container 1.

As presented above, the folding line in the rear panel 5 along which the lid 8 is rotated may advantageously be pre-provided, such as by embossing. Thereby, the risk that the first rotation of the lid 8 provides a disadvantageous folding line during the first opening of the container 1, which may result in difficult closing or breakage, is reduced.

The container 1 may advantageously be made from paper, cardboard, metal and/or plastic or laminates thereof. Preferably it is made of paper and/or cardboard.

Although other shapes than box-shape of a container 1 is possible, the box shape may be preferred in many instances. Such box-shape containers have horizontal and vertical rectangular cross sections as shown in the figures.

Figure 6:
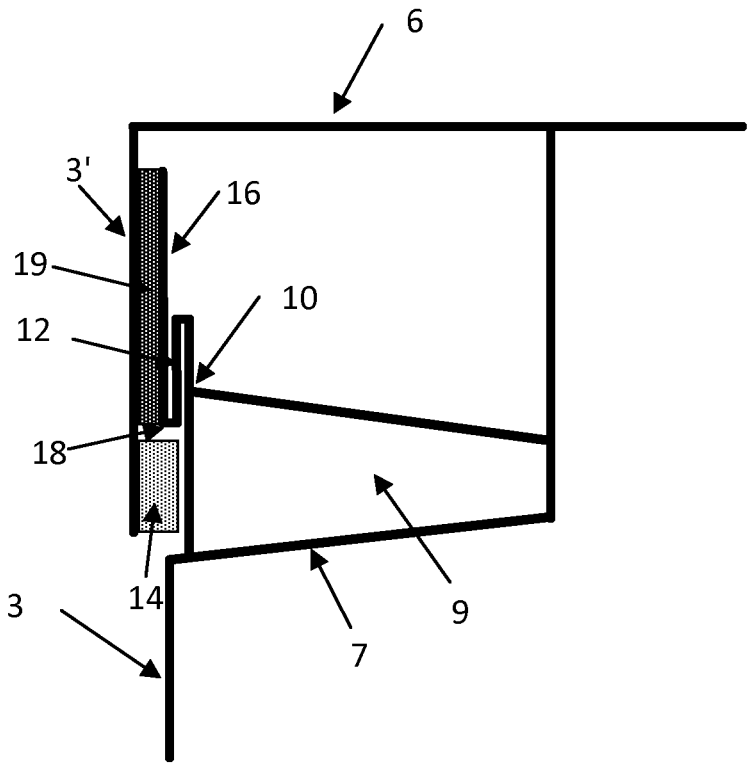
FIG. 6 is a schematic illustration of a container according to a further preferred embodiment of the invention; the same view as used in FIG. 3 has been used although the perspective has been left out for clarity reason only.

A further feature is presented in FIG. 6, namely an optional tear-off flap 16. The tear-off flap 16 is connected with flap 12 along a scoring line 18 and is glued or welded to the inside of the part of the lid 8 provided by the section 3' above the division line of the front panel 3. FIG. 6, which is a schematic cross sectional view as presented in FIG. 3 (although the perspective has been left out for clarity reasons only) discloses in further details the tear-off flap 16. As shown in FIG. 6, the tear-off flap 16 is glued or welded to the inside of the lid 8—in FIG. 6 glue or weld has reference number 19. The flap 12 is folded downwardly and the tear-off flap 16 is folded upwardly. Upon a first opening of the container 1, the scoring line 18 is broken and when the lid 8 is moved away from its closing position, the tear-off flap 16 remains on the lid 8. As shown in FIG. 7, the ledge 14 is arranged below the tear-off flap 16 and extends horizontally beyond the tear-off flap 16, so that the engagement between the flap 12 and the ledge is not hindered by the presence of the tear-off flap upon reclosing of the lid 8.

A container according to the present invention can be produced by folding the panels from one piece of material or by joining separate sheets of material.

For retail use, e.g., the container may store one or more pouch inside the container. Such a pouch may contain e.g. instant formula which is arranged in the pouch prior to sealing of the pouch. The container is made ready for receiving the pouch by assembling the container 1 without assembling the parts forming the top panel 6. Once the pouch is arranged inside the container the top panel can be formed and the container is ready for use.

In order to prevent the pouch from possibly inflicting the easy reclosing of the container, the pouch is typically provided with such dimensions that its vertical extension is smaller than the distance from the bottom panel 2 of the container 1 to the lower most position of the upper margin of each of the inner side parts 9. More preferably the outer shape of the pouch, when filled with a product, mimics the internal geometry of the container 1.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A reclosable container comprising a bottom panel, a front panel, two side panels, a rear panel, a top panel and a tear off-flap, wherein:

a lid is defined by the front panel and the two side panels, the two side panels having a division line extending downwardly sloping from the rear panel in the side panels and horizontally in at least a part of the front panel, the lid comprising the top panel and the sections of the front panel and side panels above the division line, the lid being moveable by rotation along a folding line in the rear panel between a closing position, where the lid closes the container, and a position where an open end of the container is not covered by the lid;

the front panel further comprises an inner front part extending above the division line in the front panel without being attached to the front panel above the division line;

each side panel further comprises an inner side part extending above the division line in the side panel without being attached to the side panel above the division line, and an upper margin of each of the inner side parts extending downwardly sloping towards the rear panel;

the inner front part comprises a flap extending downwardly from an upper margin of the inner front part and abutting an inner surface of the section of the front panel above the division line when the lid is in the position where the lid closes the container;

the tear-off flap is connected with the flap along a scoring line and glued or welded to an inside of the part of the lid provided by the section above the division line of the front panel.

2. The container according to claim 1, wherein the inner front part is provided by a panel provided on an inside of the front panel below the division line in the front panel, and the inner side parts are provided by panels provided on an inside of the side panels below the division line.

3. The container according to claim 1, wherein the lid comprises a ledge provided on an inner surface of the section of the front panel above the division line in a position where a lower margin of the downwardly extending flap engages with an upper edge of the ledge, when the lid is in the position where the lid closes the container.

4. The container according to claim 1, wherein a distance is provided between an upper margin of the inner front part and an inner surface of the lid, when the lid is in the position where the lid closes the container.

5. The container according to claim 1, wherein corners of the flap and/or corners of the inner front part are rounded and/or truncated.

6. The container according to claim 1, wherein a vertical distance is provided between an upper most part of the inner side parts and the upper margin of the inner front part from which the flap extends downwardly, so that the upper margin of the inner front part is provided at a higher position than the upper most part of the inner side parts.

7. The container according to claim 1, wherein the division line is a scoring line comprising a plurality of piercings in the side panels and the front panel.

8. The container according to claim 1, wherein the division line in the front panel curves downwardly between two substantially straight parts, and a section of the front panel above the division line comprises a downwardly protruding tongue resembling the curvature of the division line.

9. The container according to claim 1, wherein the folding line in the rear panel along which the lid is rotated is pre-provided.

10. The container according to claim 1, wherein the container has horizontal and vertical rectangular cross sections.

11. The container according to claim 1, wherein the container stores one or more pouches inside the container.

12. The container according to claim 11, wherein the one or more pouches has a vertical extension being smaller than a distance from the bottom panel of the container to the lower most position of the upper margin of each of the inner side parts.

13. A method of producing a container comprising a bottom panel, a front panel, two side panels, a rear panel and a top panel, wherein:

a lid is defined by the front panel and the two side panels, the two side panels having a division line extending downwardly sloping from the rear panel in the side panels and horizontally in at least a part of the front panel, the lid comprising the top panel and the sections of the front panel and side panels above the division line, the lid being moveable by rotation along a folding line in the rear panel between a closing position, where the lid closes the container, and a position where an open end of the container is not covered by the lid;

the front panel further comprises an inner front part extending above the division line in the front panel without being attached to the front panel above the division line;

each side panel further comprises an inner side part extending above the division line in the side panel without being attached to the side panel above the division line, and an upper margin of each of the inner side parts extending downwardly sloping towards the rear panel; and the inner front part comprises a flap extending downwardly from an upper margin of the inner front part and abutting an inner surface of the section of the front panel above the division line when the lid is in the position where the lid closes the container, the method comprising folding the panels from one piece of material or joining separate sheets of material, the container further comprises a tear-off flap connected with the flap along a scoring line, and the method further comprises gluing or welding the tear off flap to an inside of the part of the lid provided by the section of the front panel above the division line.

14. A method for storing of a food product, the method comprising storing food in a container comprising a bottom panel, a front panel, two side panels, a rear panel and a top panel, wherein:

a lid is defined by the front panel and the two side panels, the two side panels having a division line extending downwardly sloping from the rear panel in the side panels and horizontally in at least a part of the front panel, the lid comprising the top panel and the sections of the front panel and side panels above the division line, the lid being moveable by rotation along a folding line in the rear panel between a closing position, where the lid closes the container, and a position where an open end of the container is not covered by the lid;

the front panel further comprises an inner front part extending above the division line in the front panel without being attached to the front panel above the division line; each side panel further comprises an inner side part extending above the division line in the side panel without being attached to the side panel above the division line, and an upper margin of each of the inner side parts extending downwardly sloping towards the rear panel; and the inner front part comprises a flap extending downwardly from an upper margin of the inner front part and abutting an inner surface of the section of the front panel above the division line when the lid is in the position where the lid closes the container, the container further comprises a tear-off flap connected with the flap along a scoring line and glued or welded to an inside of the part of the lid provided by the section of the front panel above the division line.

15. The container according to claim 6, wherein the vertical distance is such that when the lid is moved to the closing position, the lid is initially guided by the flap to deflect the sections of the front panel above the division line outwardly and/or the inner front part inwardly, and the upper margins of the inner side parts further guide the sections of the front panel above the division outwardly and/or the inner side parts inwardly.

* * * * *